US007808383B2

(12) United States Patent
Cargonja et al.

(10) Patent No.: US 7,808,383 B2
(45) Date of Patent: Oct. 5, 2010

(54) METHOD AND APPARATUS FOR MONITORING AN ENVIRONMENTAL CONDITION WITH A TAG

(75) Inventors: Nikola Cargonja, San Carlos, CA (US); Timothy R. Redler, Campbell, CA (US); Richard D. Lockyer, Saratoga, CA (US); Kent G. Merritt, Sunnyvale, CA (US)

(73) Assignee: Savi Technology, Inc., Sunnyvale, CA (US)

( * ) Notice: Subject to any disclaimer, the term of this patent is extended or adjusted under 35 U.S.C. 154(b) by 901 days.

(21) Appl. No.: 11/266,018

(22) Filed: Nov. 3, 2005

(65) Prior Publication Data

US 2007/0096920 A1 May 3, 2007

(51) Int. Cl.
*G08B 13/14* (2006.01)

(52) U.S. Cl. ..... 340/572.1; 340/686.1; 340/572.9; 340/686.4; 340/693.5; 340/693.9; 340/572.8

(58) Field of Classification Search ..... 340/686.1, 340/572.1, 686.4, 693.5, 693.9, 572.8, 572.9
See application file for complete search history.

(56) References Cited

U.S. PATENT DOCUMENTS

| | | | |
|---|---|---|---|
| 3,561,634 | A | 2/1971 | Meldrum |
| 3,597,753 | A | 8/1971 | Tabankin |
| 3,665,449 | A | 5/1972 | Elder et al. |
| 3,848,243 | A | 11/1974 | Schirmer |
| 3,878,539 | A | 4/1975 | Gooding |
| 3,961,323 | A | 6/1976 | Hartkorn |
| 4,074,184 | A | 2/1978 | Dechene et al. |
| 4,258,359 | A | 3/1981 | McLamb |
| 4,438,428 | A | 3/1984 | Ober et al. |
| 4,484,181 | A | 11/1984 | Schwartz |

(Continued)

FOREIGN PATENT DOCUMENTS

| | | | |
|---|---|---|---|
| EP | 0 467 036 | A2 | 1/1992 |

(Continued)

OTHER PUBLICATIONS

Roderick E. Thorne, Philip J. Keleshian, Timothy R. Redler, Joseph S.Chan and Nikola Cargonja, U.S. Appl. No. 60/332,480, filed Nov. 9, 2001 for "Method and Apparatus for Providing Container Security with a Tag".

(Continued)

*Primary Examiner*—Daryl Pope
(74) *Attorney, Agent, or Firm*—Haynes and Boone, LLP

(57) ABSTRACT

A support includes a base having an outwardly extending projection with a passageway therethrough, and having a tag receiving portion configured to removably support a tag on the base adjacent one end of the passageway. A different arrangement involves a tag that includes a housing having an opening therethrough and having an annular surface around the opening, an annular gasket engaging the annular surface, and circuitry within the housing having a sensor located in the region of the opening and having a transmitter that can transmit wireless signals. A method includes defining a passageway that provides fluid communication between an interior and exterior of a container, supporting a tag on the exterior of the container, and causing the tag to sense, at a location in the region of an end of the passageway, a condition within the container.

24 Claims, 7 Drawing Sheets

U.S. PATENT DOCUMENTS 4,683,461 A 7/1987 Torre
4,688,244 A 8/1987 Hannon et al.
4,808,974 A 2/1989 Cantley
5,072,212 A 12/1991 Sorenson
5,247,279 A 9/1993 Sato
5,315,563 A * 5/1994 Lichtenfels et al. ..... 367/99
5,341,123 A 8/1994 Schuman, Sr. et al.
5,410,899 A 5/1995 McConnell
5,422,627 A 6/1995 Tap et al.
5,448,220 A 9/1995 Levy
5,479,152 A 12/1995 Walker et al.
5,499,014 A 3/1996 Greenwaldt
5,568,951 A * 10/1996 Morgan ..... 292/307 A
5,572,191 A 11/1996 Lundberg
5,615,247 A 3/1997 Mills
5,646,592 A * 7/1997 Tuttle ..... 340/545.6
5,656,996 A 8/1997 Houser
5,729,199 A 3/1998 Cooper et al.
5,735,495 A 4/1998 Kubota
5,804,810 A 9/1998 Woolley et al.
5,844,482 A 12/1998 Guthrie et al.
5,907,812 A 5/1999 Van De Berg
5,913,180 A 6/1999 Ryan
5,917,433 A 6/1999 Keillor et al.
5,936,523 A 8/1999 West
5,939,982 A 8/1999 Gagnon et al.
5,959,568 A 9/1999 Woolley
5,999,091 A 12/1999 Wortham
6,204,764 B1 3/2001 Maloney
6,236,911 B1 5/2001 Kruger
6,271,753 B1 8/2001 Shukla
6,274,856 B1 8/2001 Clothier et al.
6,281,793 B1 8/2001 Haimovich et al.
6,285,282 B1 9/2001 Dorenbosch et al.
6,346,886 B1 * 2/2002 De La Huerga ..... 340/573.1
6,444,961 B2 9/2002 Clothier et al.
6,483,473 B1 11/2002 King et al.
6,497,656 B1 12/2002 Evans et al.
6,512,455 B2 1/2003 Finn et al.
6,608,554 B2 8/2003 Lesesky et al.
6,736,316 B2 5/2004 Neumark
6,744,352 B2 6/2004 Lesesky et al.
6,747,558 B1 6/2004 Thorne et al.
6,748,292 B2 6/2004 Mountz
6,753,775 B2 6/2004 Auerbach et al.
6,796,142 B2 9/2004 Burn
6,844,829 B2 1/2005 Mayor
6,919,803 B2 7/2005 Breed
6,975,224 B2 12/2005 Galley, III et al.
7,023,348 B2 * 4/2006 Hogan et al. ..... 340/572.8
7,034,683 B2 4/2006 Ghazarian
7,042,354 B2 * 5/2006 Auerbach et al. ..... 340/539.31
7,091,864 B2 * 8/2006 Veitch et al. ..... 340/572.8
7,098,784 B2 8/2006 Easley et al.
7,132,926 B2 11/2006 Vaseloff et al.
7,242,296 B2 7/2007 Wang et al.
7,321,308 B1 * 1/2008 Feibelman ..... 340/572.8
7,333,019 B2 * 2/2008 Redler et al. ..... 340/572.8
2004/0012502 A1 1/2004 Rasmussen
2004/0069850 A1 4/2004 De Wilde
2004/0119588 A1 6/2004 Marks
2004/0174259 A1 9/2004 Peel et al.
2004/0183673 A1 9/2004 Nageli
2004/0226800 A1 11/2004 Pierga et al.
2004/0233041 A1 11/2004 Bohman et al.
2004/0263329 A1 12/2004 Cargonja et al.
2005/0134457 A1 6/2005 Rajapakse et al.
2005/0151643 A1 7/2005 Rajapakse et al.
2006/0012481 A1 1/2006 Rajapakse et al.
2006/0290496 A1 12/2006 Peeters

FOREIGN PATENT DOCUMENTS

EP 0 825 554 A1 2/1998
EP 0 984 400 A2 3/2000
WO WO 98 / 32092 7/1998
WO WO 01 / 08116 2/2001
WO WO 01 / 27891 4/2001

OTHER PUBLICATIONS

Nikola Cargonja, Philip J. Keleshian, Roderick E. Thorne and Steven J. Farrell, U.S. Appl. No. 60/464,067, filed Apr. 18, 2003 for "Techniques for Detecting Intrusion Into a Cargo Container".
Nikola Cargonja, Philip J. Keleshian, Roderick E. Thorne and Ravindra U. Rajapakse, U.S. Appl. No. 60/496,056, filed Aug. 18, 2003 for "Technique Using Cargo Container Motion as a Factor in Intrusion Detection".
Gustavo Padilla and Roderick E. Thorne, U.S. Appl. No. 60/504,580, filed Sep. 19, 2003 for "Technique Using Cargo Container Door Sensor as a Factor in Intrusion Detection".
Nicholas D. Cova, Mark S. Weidick, and Blair B. LaCorte, U.S. Appl. No. 60/518,553, filed Nov. 7, 2003 for "Method and Apparatus for Increased Container Security".
Ravindra U. Rajapakse, Roderick E. Thorne, Robert Fraser Jennings, Steven J. Farrell and Liping Julia Zhu, U.S Appl. No. 60/588,229, filed Jul. 15, 2004 for "Method and Apparatus for Effecting Control or Monitoring Within a Container".
Nicholas D. Cova, Mark S. Weidick and Blair B. LaCorte, U.S. Appl. No. 10/984,026, filed Nov. 8, 2004 for "Method and Apparatus for Increased Container Security".
Ravindra U. Rajapakse, Steven J. Farrell, Nicholas D. Cova, Mark S. Weidick, Roderick E. Thorne and Gustavo Padilla, U.S. Appl. No. 60/514,968, filed Oct. 27, 2003 for "Mechanisms for Secure RF Tags on Containers".
Steven J. Farrell, Blair B. LaCorte, and Ravindra U. Rajapakse, U.S. Appl. No. 11/158,300, filed Jun. 21, 2005 for "Method and Apparatus for Monitoring Mobile Containers".
Richard D. Lockyer, U.S. Appl. No. 60/732,240, filed Nov. 1, 2005 for "Apparatus and Method for Capacitive Sensing of Door Position".
Richard D. Lockyer and David H. Beauley, U.S. Appl. No. 11/336,402, filed Jan. 20, 2006 for "Method and Apparatus for Capacitive Sensing of Door Position".

* cited by examiner

METHOD AND APPARATUS FOR MONITORING AN ENVIRONMENTAL CONDITION WITH A TAG

FIELD OF THE INVENTION

This invention relates in general to monitoring of containers during shipment and, more particularly, to monitoring of environmental conditions within a container.

BACKGROUND

It is desirable to be able to monitor items or containers during shipment. One known technique for tracking items or containers is to mount a radio frequency identification (RFID) tag on each item or container to be tracked. These RFID tags can transmit wireless signals, and some tags can also receive wireless signals. Where the object being tracked is a container, there are situations in which it is desirable to be able to monitor one or more environmental conditions within the container, such as the temperature and/or humidity.

SUMMARY OF THE INVENTION

One of the broader forms of the invention relates to an apparatus with a support that includes: a base; a projection extending outwardly from the base in a selected direction and having a passageway therethrough, the passageway having first and second ends respectively adjacent and remote from the base; and a tag receiving portion provided on the base and configured to removably support a tag on the base adjacent the first end of the passageway.

Another of the broader forms of the invention involves an apparatus with a tag that includes: a housing having a wall portion with an opening therethrough and having thereon an annular surface portion extending around the opening; an annular gasket engaging the annular surface portion; and circuitry disposed within the housing, the circuitry including a sensor located in the region of the opening, and a transmitter that can transmit wireless signals.

Still another of the broader forms of the invention involves a method that includes: defining a passageway providing fluid communication between an interior and exterior of a container; supporting a tag on the exterior of the container in the region of an outer end of the passageway; and causing the tag to sense, at a location in the region of the outer end of the passageway, an environmental condition within the container.

BRIEF DESCRIPTION OF THE DRAWINGS

A better understanding of the present invention will be realized from the detailed description that follows, taken in conjunction with the accompanying drawings, in which.

DETAILED DESCRIPTION

Figure 1:
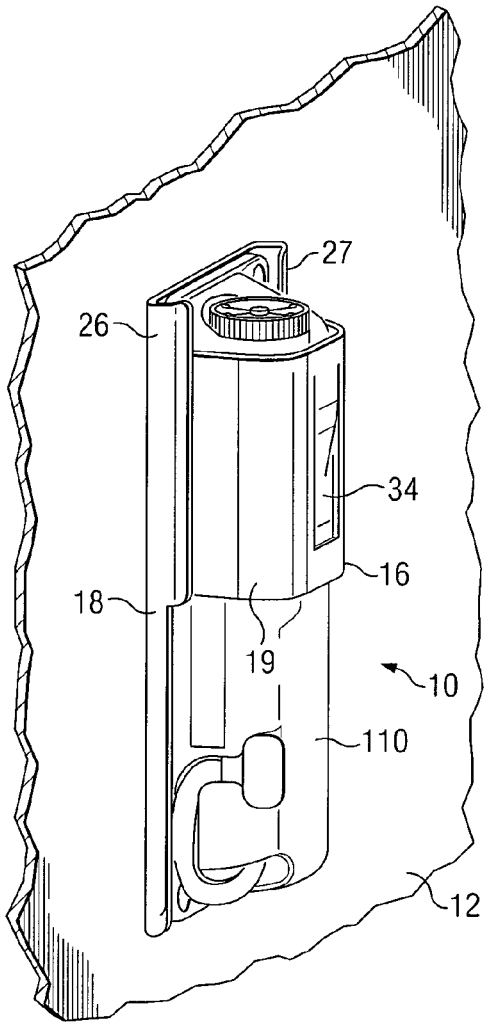
FIG. 1 is a diagrammatic perspective view showing an apparatus that embodies aspects of the present invention, and also showing a wall of a container.
Figure 2:
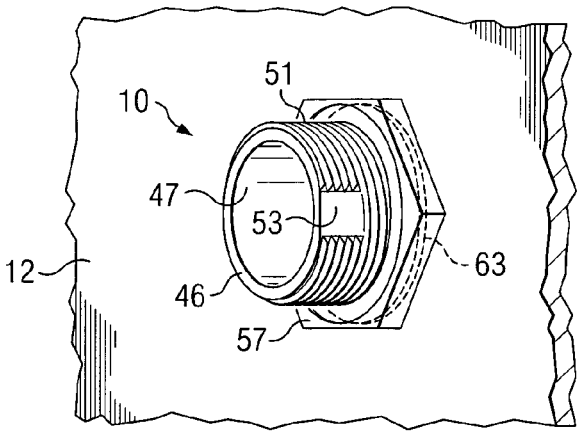
FIG. 2 is a different diagrammatic perspective view of the apparatus of FIG. 1, taken from an opposite side of the container wall.
Figure 3:
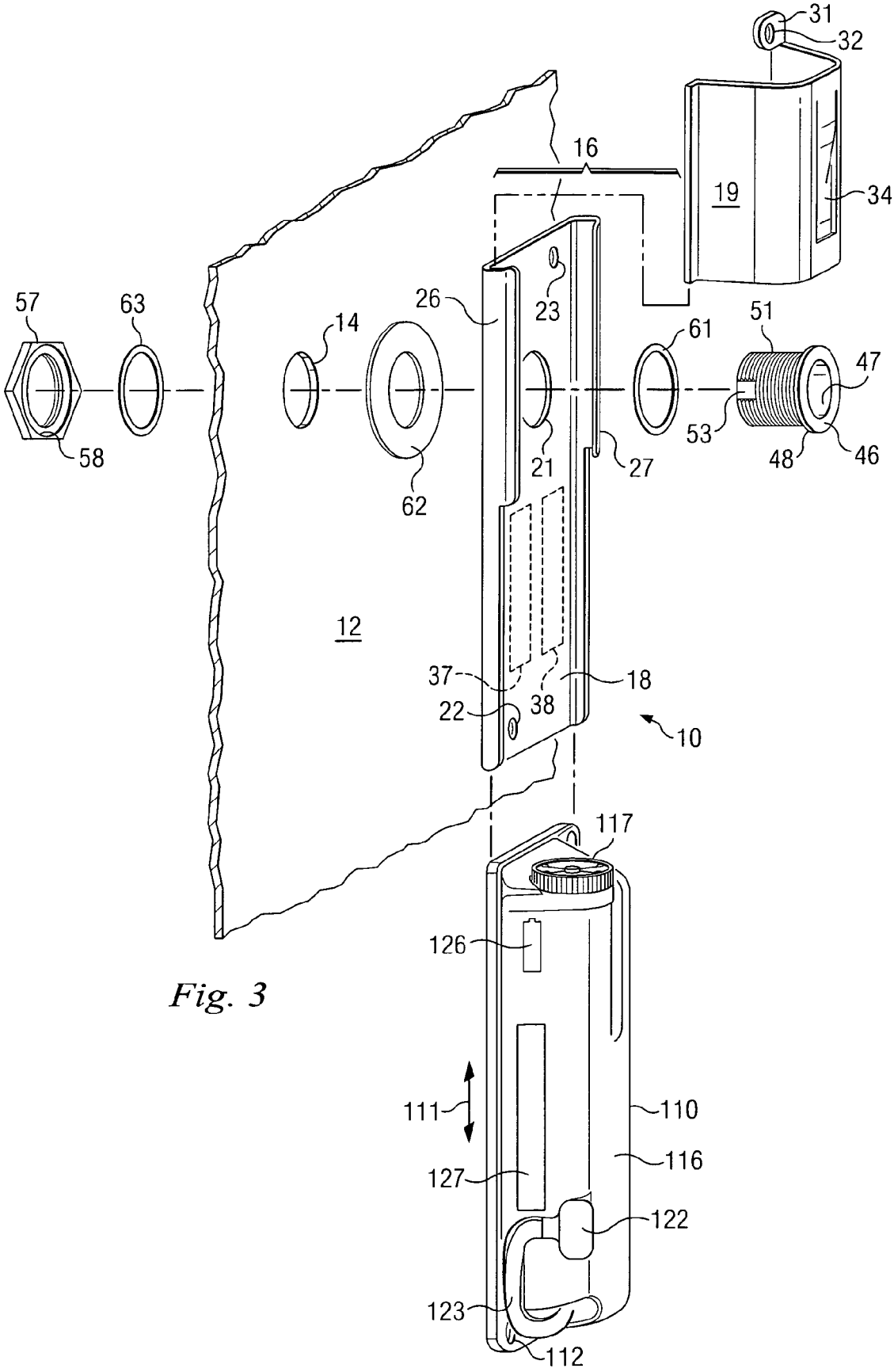
FIG. 3 is a diagrammatic exploded perspective view of the apparatus and container wall of FIG. 1.

FIG. 1 is a diagrammatic perspective view showing an apparatus 10 that embodies aspects of the present invention, and also showing a portion of a wall 12 of a container. FIG. 2 is a different diagrammatic perspective view of the apparatus 10, taken from an opposite side of the container wall 12. FIG. 3 is a diagrammatic exploded perspective view of the apparatus 10 and the container wall 12.

Referring to FIGS. 1-3, the container wall 12 is made of metal, and has a circular opening 14 therethrough. The container wall 12 is part of a container or tank used to ship a product. As one example, the U.S. Navy uses metal containers to ship engines, and there is a need to monitor environmental conditions within the container such as temperature and/or humidity. Alternatively, the container 12 could be any of variety of other types of metal containers that are used to ship various different products.

The apparatus 10 has a support 16 that includes a base plate 18 and a retainer 19. In the disclosed embodiment, the base plate 18 and the retainer 19 are each made from stainless steel. However, either part could alternatively be made from any other suitable material. The base plate 18 has a circular opening 21 therethrough, with approximately the same diameter as the circular opening 14 through the container wall 12. The base plate 18 also has two smaller openings 22 and 23 provided near diagonally opposite corners thereof, and the openings 22 and 23 are each internally threaded. The base plate 18 has two flanges 26 and 27 along opposite sides thereof. The flanges 26 and 27 each extend outwardly in a direction away from the container wall 12, and are each angled slightly inwardly toward the other thereof. As viewed in FIG. 3, the upper portion of each flange 26 and 27 is slightly wider than the lower portion thereof.

The retainer 19 is a stainless steel sheet bent to approximately a U-shape. The upper portions of the angled flanges 26 and 27 engage opposite edges of the retainer 19, in order to help maintain the retainer 19 on the base plate 18. The retainer 19 has on one side an outwardly projecting tab 31, with an opening 32 therethrough. When the retainer 19 is installed on the base plate 18, the opening 32 in the tab 31 is coaxially aligned with the opening 23 in the base plate 18. The retainer 19 has a U-shaped slit that defines a resilient leaf spring 34, for a purpose discussed in more detail later.

With reference to FIG. 3, two strips 37 and 38 of double-sided tape are adhesively secured to the side of the base plate 18 that faces the container wall 12. The tape strips 37 and 38 serve to adhesively secure the base plate 18 to the container wall 12, with the openings 14 and 21 in coaxial alignment. The double-sided tape strips 37 and 38 are a type of tape known as VHB (very high bond) tape. In the disclosed embodiment, the tape strips 37 and 38 are obtained commercially as part number 4926 from 3M Corporation of St. Paul, Minn. However, they could alternatively be some other type of tape. Also, instead of using the tape strips 37 and 38, the base plate 18 could be supported on the container wall 12 in any other suitable manner.

The support 16 further includes a tubular fitting 46 with a cylindrical passageway 47 extending axially through it. In the disclosed embodiment, the fitting 46 is made of anodized aluminum, but it could alternatively be made of any other suitable material. The fitting 46 has external threads 51 thereon, and an outwardly-projecting annular flange 48 at one end. The end of the fitting 46 remote from the flange 48 has two flat surfaces 53 on diametrically opposite sides thereof, one of which is visible in FIGS. 2 and 3. The threaded portion of the fitting 46 extends through the aligned openings 21 and 14 in the base plate 18 and container wall 12. A nut 57 is provided within the container, and engages the threads 51 of the fitting 46. The nut 57 has an annular recess 58 on the side thereof facing the container wall 12. The nut 57 is made of anodized aluminum, but could alternatively be made of any other suitable material.

The apparatus 10 further includes three annular gaskets 61, 62 and 63, each of which encircles the threaded portion 51 of the fitting 46. The gasket 61 is disposed between the base plate 18 and the flange 48 on the fitting 46. The gasket 61 is a nylon washer in the disclosed embodiment, but could alternatively be made from any other suitable material. Since the base plate 18 is made from stainless steel and the fitting 46 is made from anodized aluminum, the gasket 61 serves to maintain a small spacing between the base plate 18 and the flange 48, in order to avoid corrosion that might otherwise occur as a result of physical contact between dissimilar metals.

The gasket 62 is disposed between the base plate 18 and the container wall 12. In the disclosed embodiment, the gasket 62 is made of Neoprene, but it could alternatively be made of any other suitable material. The gasket 63 is disposed between the nut 57 and the container wall 12, and is partially received within the annular recess 58 in the nut 57. The gasket 63 maintains a small spacing between the nut 57 and the container wall 12, in order to avoid corrosion that might otherwise occur as a result of physical contact between dissimilar metals. The gasket 63 is made of Neoprene in the disclosed embodiment, but could alternatively be made of any other suitable material. The gaskets 62 and 63 facilitate a fluid seal between the fitting 46 and the container wall 12, thereby leaving the passageway 47 as the only path of fluid communication through the opening 14 in the container wall.

The apparatus 10 further includes a radio frequency identification (RFID) tag 110. The tag 110 can be slidably inserted into and removed from the support 16, in directions indicated by the double-headed arrow 111 in FIG. 3. The tag 110 has openings in diagonally opposite corners, one of which is visible at 112 in FIG. 3. When the tag 110 is removably received within the support 16, the opening 112 in the tag is aligned with the threaded opening 22 in the base plate 18, and the other opening in the tag is aligned with the threaded opening 23 in the base plate, and also with the opening 32 through the tab 31. Two not-illustrated screws each extend through a respective one of the openings in the tag 110, and one of the screws also extends through the opening 32 in the tab 31. These two screws respectively engage the threaded openings 22 and 23 in the base plate 18, so as to removably secure the tag 110 within the support 16, and also removably secure the retainer 19 against movement relative to the base plate 18. When the tag 110 is removably secured in this manner within the support 16, the leaf spring 34 on the retainer 19 engages the tag 110, and resiliently urges the tag in a direction toward the base plate 18.

Turning in more detail to the tag 110, and with reference to FIG. 3, the tag 110 has a housing 116. A knurled cap 117 can be unscrewed and removed in order to provide access to an internal battery compartment of the tag 110, so that a battery within the compartment can be replaced. A flexible retaining element 123 has one end fixedly secured to the housing of the tag, and has a stopper 122 at its other end. In FIG. 3, the stopper 122 is removably inserted in an opening that provides access to an electrical connector for a serial port. Two information labels 126 and 127 are adhesively secured to the exterior of the housing.

Figure 4:
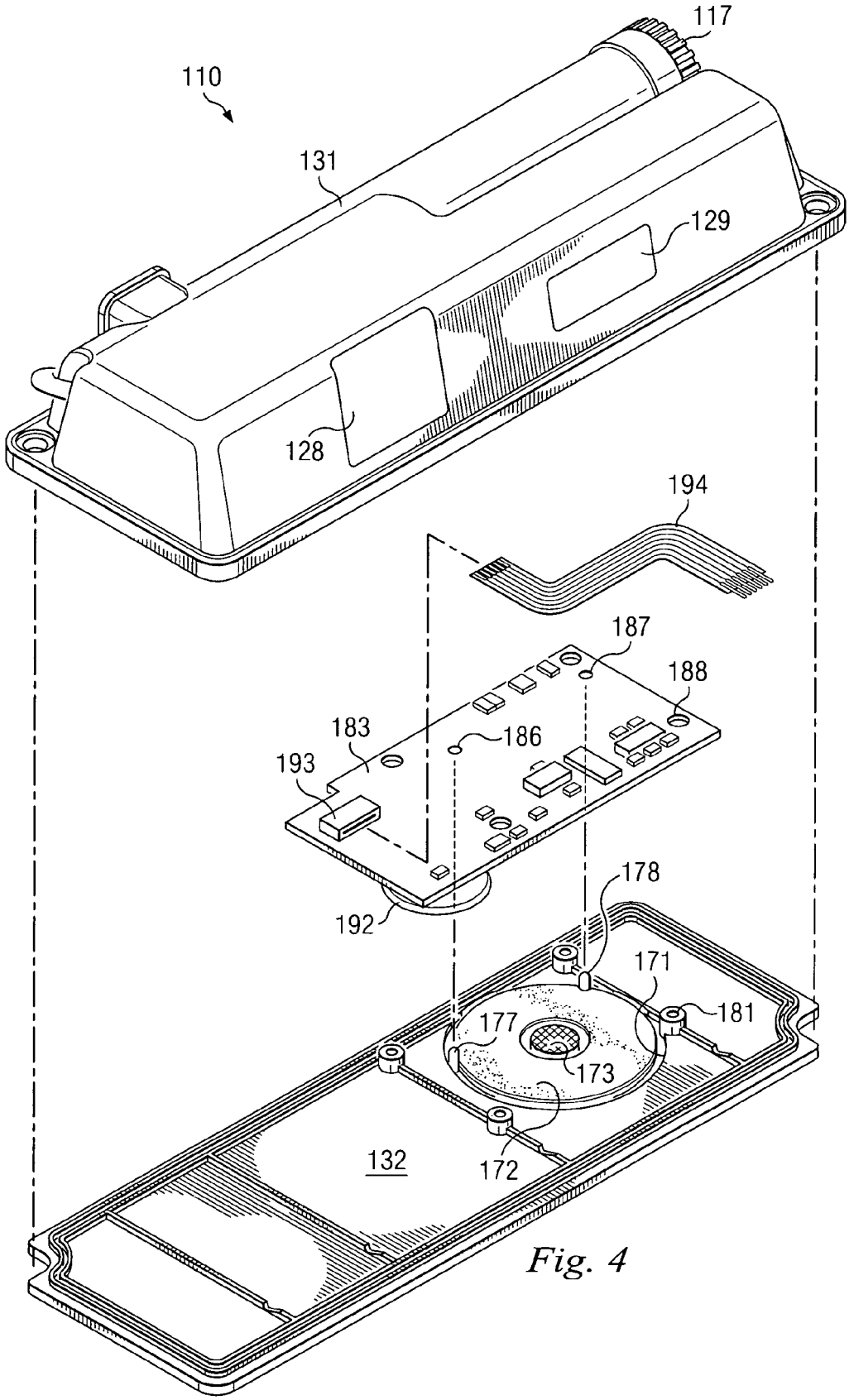
FIG. 4 is a diagrammatic exploded perspective view of a tag that is a component of the apparatus of FIG. 1.

FIG. 4 is a diagrammatic exploded perspective view of the tag 110. Two further information labels 128 and 129 are visible in FIG. 4. The housing of the tag includes an upper housing part 131 and a lower housing part 132, which are each made of a sturdy plastic material. During assembly of the tag 110, the lower housing part 132 is ultrasonically bonded along the entire length of its peripheral edge to the upper housing part 131.

Figure 5:
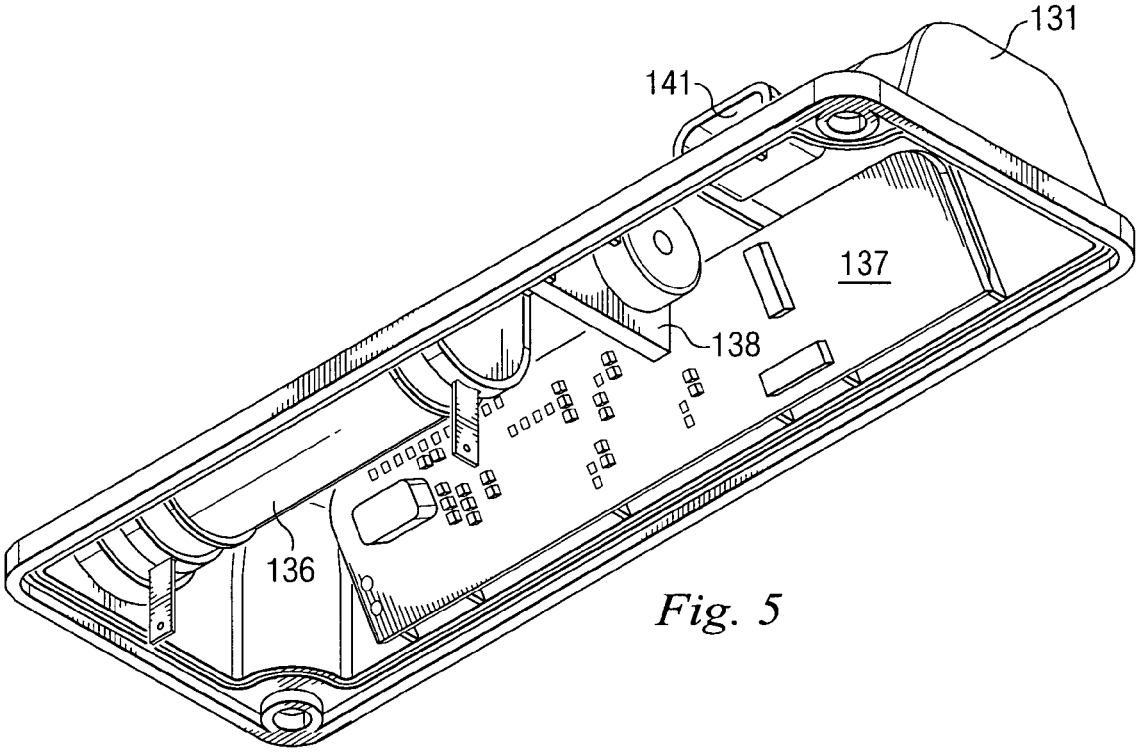
FIG. 5 is a diagrammatic perspective bottom view of an upper housing part of the tag of FIG. 4, showing some structural components within the upper housing part that are not visible in FIG. 4.

FIG. 5 is a diagrammatic perspective bottom view of the upper housing part 131, showing some structural components within the upper housing part that are not visible in FIG. 4. In this regard, FIG. 5 shows a battery compartment 136 within the upper housing part 131. As discussed above, a battery within this compartment can be replaced by removing the knurled cap 117 (FIG. 4). FIG. 5 also shows a main circuit board 137 and beeper circuit board 138 that are each mounted within the upper housing part 131. An opening 141 in the upper housing part 131 has therein the previously-mentioned electrical connector for a serial interface. The opening 141 of FIG. 5 removably receives part of the rubber stopper 122 of FIG. 3, in order to protect the electrical connector from environmental conditions. The battery in the battery compartment 136 is electrically coupled by not-illustrated wires to the main circuit board 137, which in turn is electrically coupled by not-illustrated wires to the electrical connector within the opening 141. The main circuit board 137 is also coupled by not-illustrated wires to the beeper circuit board 138.

Figure 6:
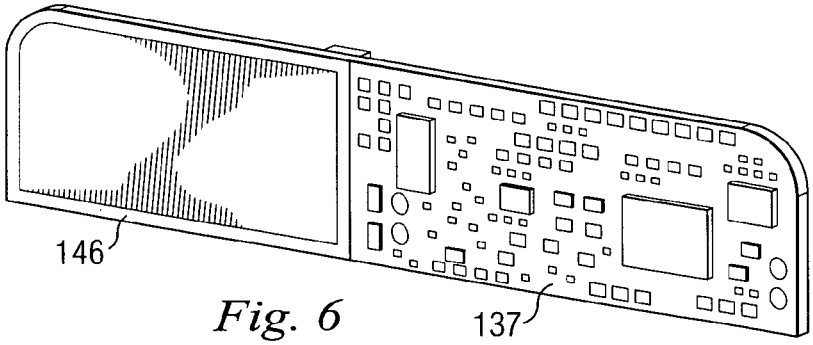
FIG. 6 is a diagrammatic perspective view showing a circuit board that is a component of the tag of FIG. 4.

FIG. 6 is a diagrammatic perspective view showing the main circuit board 137, and in particular showing a side thereof opposite from the side that is visible in FIG. 5. FIG. 6 shows that one end of the main circuit board 137 has a conductive loop 146, which serves as an antenna. The circuitry on the main circuit board 137 includes a transmitter circuit of a known type, which uses the loop antenna 146 to send and receive wireless signals.

Figure 7:
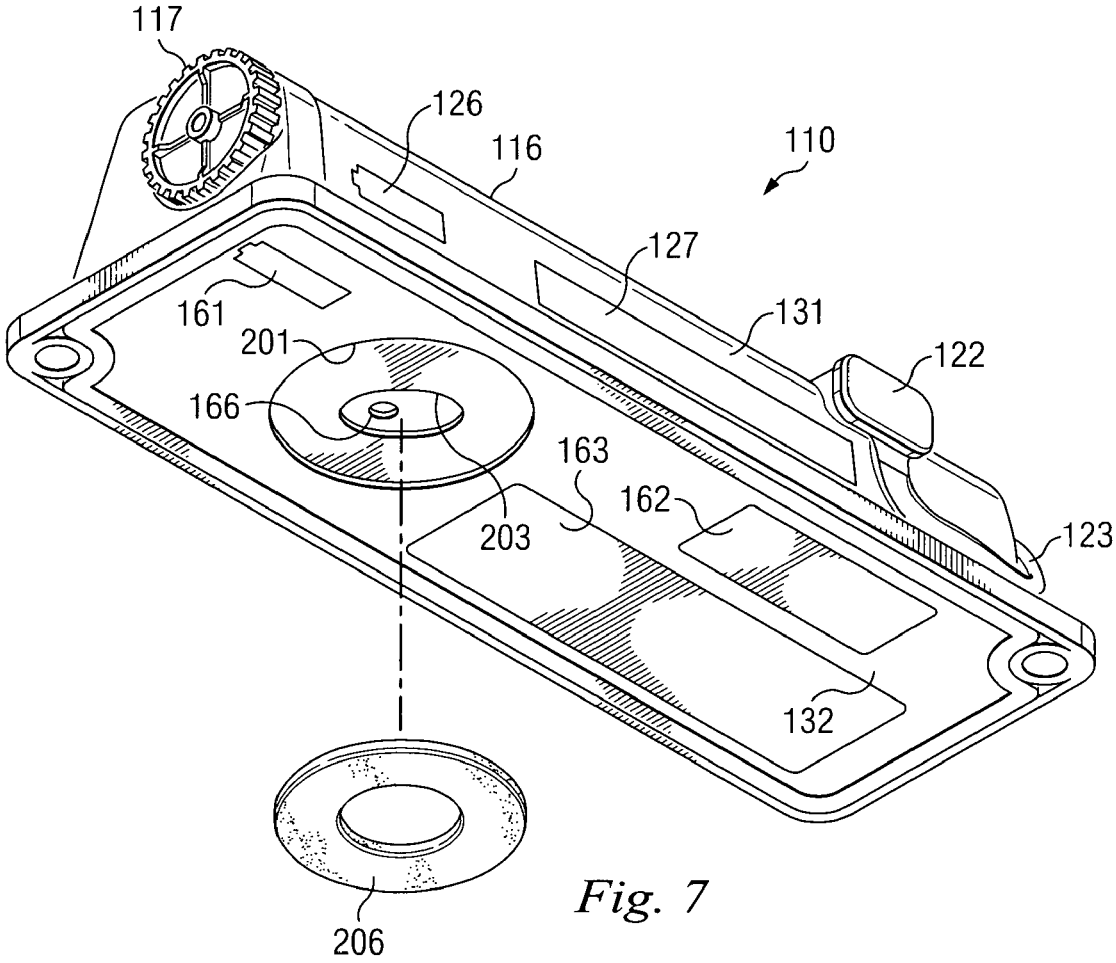
FIG. 7 is a diagrammatic exploded perspective bottom view of the tag of FIG. 4.

FIG. 7 is a diagrammatic exploded perspective bottom view of the tag 110. Three additional information labels 161-163 are visible on the bottom part 132 of the housing. FIG. 7 shows an opening 166 that extends through the bottom part 132 of the tag housing 116. With reference to FIGS. 4 and 7, the inner side of the bottom housing part 132 has a shallow circular recess 171 that is approximately concentric to the opening 166. An annular gasket 172 is provided in the recess 171, and engages an annular surface portion that extends around the opening 166. The gasket 172 has a thickness greater than the depth of the recess 171. In the disclosed embodiment, the gasket 172 is made from the same type of double-sided tape as the tape strips 37 and 38 (FIG. 3), and the adhesive on one side of the gasket 172 secures it to the annular surface portion on the housing part 132.

A sheet 173 of filter material is adhesively secured to the inner surface of the housing part 132, within the central opening through the gasket 172. The filter sheet 173 is positioned so as to extend across the opening 166 (FIG. 7), on the inner side of the opening. The filter sheet 173 has an adhesive on one side that secures it to the inner surface of the housing part 132. Thus, any air or other fluid passing through the opening 166 must pass through the filter sheet 173. In the enclosed embodiment, the filter sheet 173 with adhesive on one side is obtained commercially as part number VE60814 from W. L. Gore and Associates, Inc. of Newark, Del. and Elkton, Md.

The inner side of the housing bottom part 132 has two posts 177 and 178 that project upwardly from locations along the peripheral edge of the shallow recess 171. The housing part 132 also has four bosses provided at angularly spaced locations around the recess 171, each boss having a threaded opening 181 therein. A sensor circuit board 183 has two openings 186 and 187 therein, which each receive the upper end of a respect one of the posts 177 and 178. As discussed above, the annular gasket 182 has an adhesive surface on the upper side thereof, and this surface engages and is adhesively secured to an annular surface on the underside of the sensor circuit board 183. The circuit board 183 has four holes 188 that are each aligned with a respect one of the threaded holes 181 in the bottom housing part 132. Four not-illustrated screws each extend through a respective one of the holes 188, and each threadedly engage a respective one of the holes 181, in order to removably hold the sensor circuit board 183 on the bottom housing part 132.

The circuitry on the sensor circuit board 183 includes a backup battery 192. The backup battery 192 keeps a small section of circuitry supplied with power when the main battery becomes discharged, and also during replacement of the main battery. The circuitry operated by the battery 192 includes a portion that maintains time and date information. An electrical connector 193 is mounted on the sensor circuit board 183. A ribbon cable 194 extends from the connector 193 to an electrical connector on the main circuit board 137 (FIG. 5).

Figure 8:
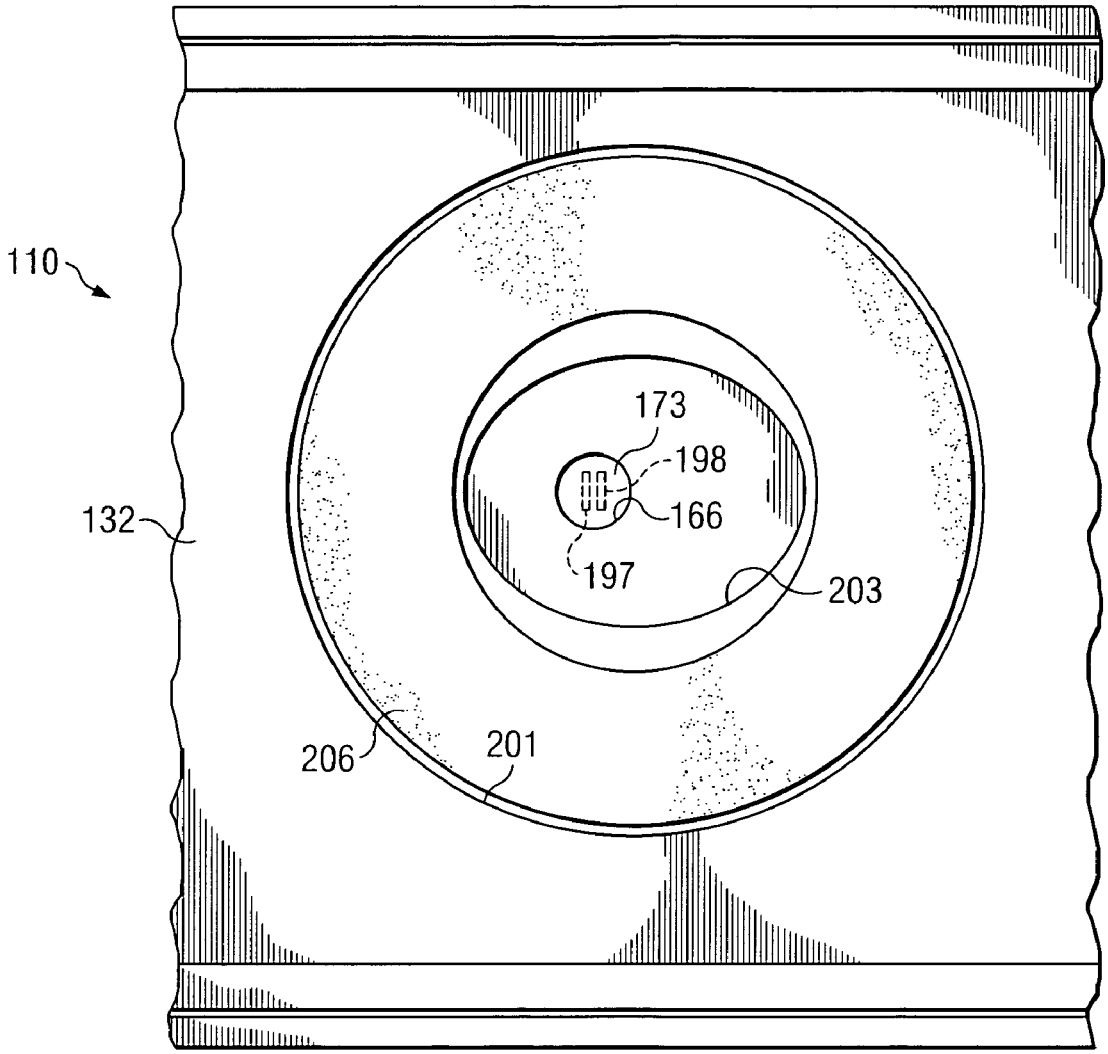
FIG. 8 is a diagrammatic fragmentary bottom view of a portion of the tag of FIG. 4.

FIG. 8 is a diagrammatic fragmentary bottom view of part of the tag 110. In FIG. 8, the above-mentioned the sheet 173 of filter material is visible through the opening 166 in the bottom housing part 132. Behind the sheet 173 are two sensors 197 and 198, which are mounted on the bottom side of the sensor circuit board 183 (FIG. 4). The sensors 197 and 198 are not visible in FIG. 4, and are shown in broken lines in FIG. 8 because they are located behind the sheet 173 of filter material. The sensors 197 and 198 are commercially available parts of a known type. In the disclosed embodiment, the sensor 197 measures temperature, and the sensor 198 measures humidity. However, either of these sensors could alternatively measure some other condition.

With reference to FIGS. 7 and 8, the outer side of the bottom housing part 132 has a shallow circular recess 201, which is approximately concentric to the opening 166. Near the center of the recess 201 is a shallow sensing recess 203 of smaller size. In the disclosed embodiment, the sensing recess 203 has a shape that is approximately an oval. The opening 166 communicates at one end with the sensing recess 203.

An annular gasket 206 is provided within the recess 201, and extends around the sensing recess 203. The gasket 206 has a thickness greater than the depth of the recess 201. In the disclosed embodiment, the gasket 206 is made of PORON® foam, and is secured by a suitable adhesive, such as an epoxy adhesive, to an annular surface that extends around the sensing recess 203 within the recess 201. As discussed above in association with FIGS. 1 and 3, when the tag 110 is removably disposed in the support 16, the leaf spring 34 engages the tag and resiliently urges it toward the base plate 18. With reference to FIGS. 7 and 8, this causes the outer side of the gasket 206 to be resiliently urged against the base plate 18, thereby effecting a fluid seal around the opening 166, between the base plate 18 and the bottom housing part 132.

The beeper circuit board 138 can be used to generate sound that allows the tag 110 to be located when it is mounted on a container. For example, a person with a handheld device can cause the handheld device to transmit a wireless signal that uniquely identifies the tag 110, and that instructs the tag to use the beeper circuit board 138 to emit a beeping sound. The person can then walk toward the beeping sound and easily locate the tag 110.

As discussed above, the support 16 is designed for use with metallic containers. In particular, in the case of a metallic container, the tag 110 must be disposed outside the metal container in order to be able to reliably transmit and receive wireless signals, but must also be able to monitor conditions within the container. The passageway 47 in the fitting 46 gives the tag 110 access to the interior of a container, so that the tag can monitor interior conditions such as temperature and humidity. In contrast, in the case of non-metallic containers, a different approach can be used.

Figure 9:
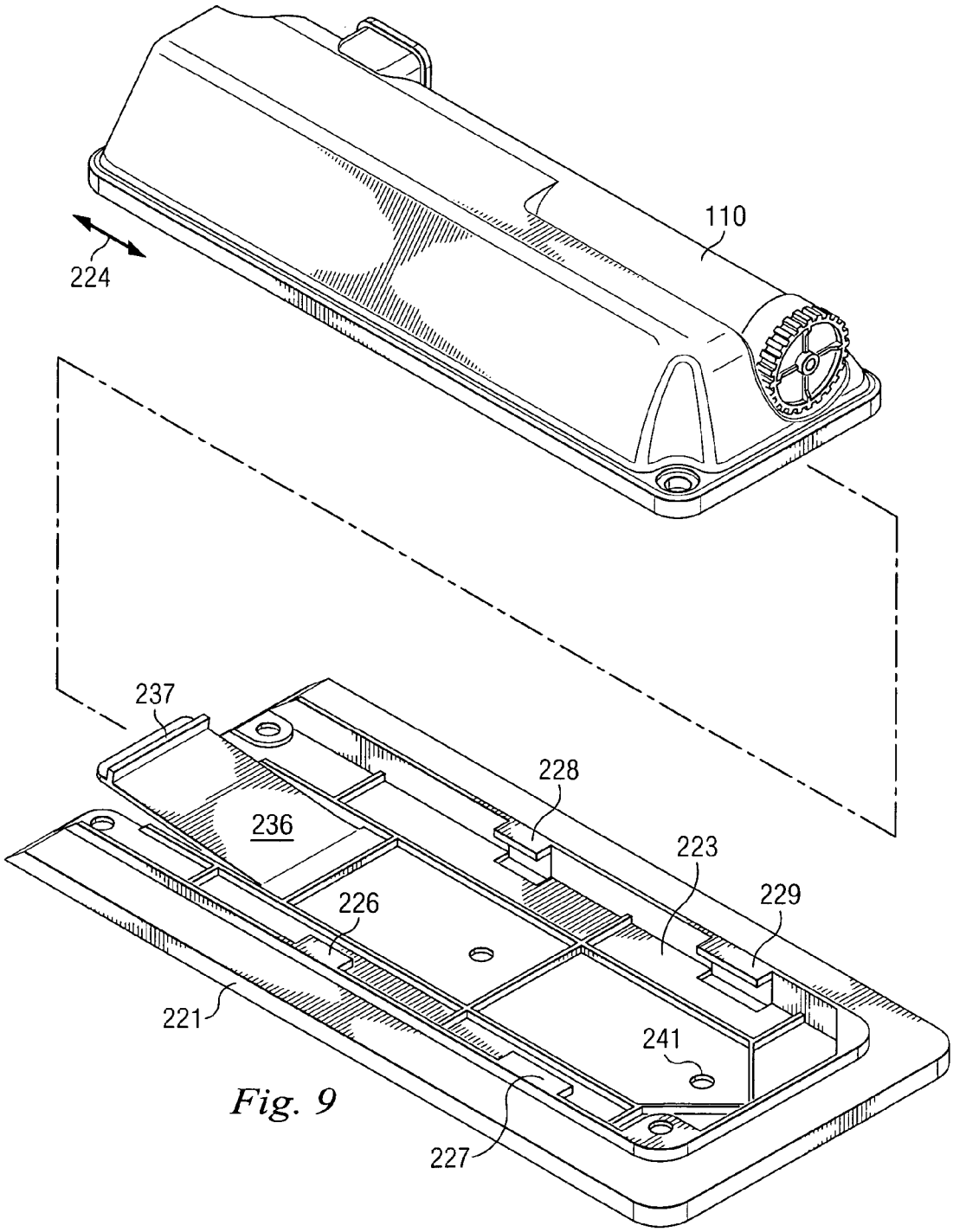
FIG. 9 is a diagrammatic perspective view of an alternative embodiment that includes aspects of the present invention, showing the tag of FIG. 1 with a bracket that can removably support the tag.

More specifically, FIG. 9 is a diagrammatic perspective view showing the tag 110, and also showing a bracket 221 that can be used instead of the support 16. The bracket 221 can be used in association with non-metallic containers, where the tag 110 can reliably transmit and receive wireless signals, even if it is inside the container. In the disclosed embodiment, the bracket 221 is made from the same material as the housing 116 of the tag 110. However, the bracket 221 could alternatively be made from any other suitable material. The bracket 221 includes a base part 223. The tag 110 can be inserted into and removed from the base part 223 in directions parallel to the double-headed arrow 224 in FIG. 9. The base part 223 has holding portions 226-229, which slidably receive a peripheral flange on the tag 110, in order to help retain the tag on the bracket 221. The base part 223 has a resilient tongue 236 with a rib 237 at the outer end. The base part 223 also has an opening 241 therethrough.

As the tag 110 is slid into the bracket 221, the tag engages the tongue 236 and moves it away from the position shown in FIG. 9, against the inherent resilience of the tongue. Then, when the tag 110 has reached a fully inserted position, the tongue's inherent resilience moves it partway back toward its original position, so that the rib 237 moves to a position engaging a peripheral edge of the tag. The engagement of the rib 237 with the tag edge prevents the tag from moving out of the bracket 221. In order to remove the tag 110 from the bracket 221, the outer end of the tongue 236 is manually pressed, so as to move the rib 237 out of engagement with the edge of the tag. The tag 110 can then be slid out of the bracket 221.

Although the bracket 221 of FIG. 9 is suitable for situations where the tag 110 is to be used inside a non-metallic container, it is also possible to put the tag 110 inside a non-metallic container without the bracket 221. For example, if Styrofoam or some other material is used within the container as packing material for an item being shipped, the packing material can be configured to have a recess that is shaped to receive the tag and that provides the sensors 197-198 with access to the ambient environment in the container.

The operation of the disclosed embodiments will now be briefly described. With reference to FIGS. 1-8, when the apparatus 10 is assembled and mounted on a container wall 12, the passageway 47 and the opening 166 provide fluid communication from the interior of the container to the temperature and humidity sensors 197 and 198 (FIG. 8), through the sheet 173 of filter material. Consequently, the tag 110 can use the sensors 197 and 198 to monitor the temperature and humidity within the container. The tag 110 can use its transmitter circuit and its loop antenna 146 to transmit wireless signals that include either the measured temperature and humidity, or information relating to these measurements. For example, if the humidity within the container is supposed to remain within a specified range, but the tag 110 measures a humidity level outside this range, the tag can transmit a wireless signal indicating that the humidity is outside the specified range.

In the embodiment of FIG. 9, the opening 241 and the opening 166 provide fluid communication from the temperature and humidity sensors 197 and 198 (FIG. 8) through the filter sheet 173 to the ambient environment externally of the tag and bracket. Consequently, the tag 110 can monitor the ambient temperature and humidity, and can transmit wireless signals that contain the measurements or information relating to the measurements.

The foregoing discussion uses terms relating to direction and orientation, such as upper, lower, inner, outer, and so forth. These terms are used for convenience and in relation to the particular views in the accompanying drawings, and are not intended to be considered limiting with respect to the scope of protection.

Although selected embodiments have been illustrated and described in detail, it should be understood that a variety of substitutions and alterations are possible without departing from the spirit and scope of the present invention, as defined by the following claims.

What is claimed is:

1. An apparatus comprising:

a support that includes:

a base;

a projection extending outwardly from said base in a selected direction and having a passageway therethrough, said passageway having first and second ends respectively adjacent and remote from said base; and a tag receiving portion provided on said base and configured to removably support a tag on said base adjacent said first end of said passageway;

sealing structure cooperable with said support, wherein when said projection is extending through an opening in a wall, said sealing structure effects a fluid seal between the wall and said support while said passageway provides fluid communication between opposite sides of the wall;

wherein said projection has threads; and wherein said sealing structure includes a nut that threadedly engages said projection on a side of a wall opposite from said base, an annular first gasket that extends around said projection between said nut and the wall, and an annular second gasket that extends around said projection between said base and the wall.

2. An apparatus according to claim 1, wherein said support includes mounting structure on a side of said base facing in said selected direction for removably supporting said base on a wall.

3. An apparatus according to claim 2, wherein said mounting structure includes a strip of double-sided tape.

4. An apparatus according to claim 1, wherein said base has an opening therethrough;

wherein said projection is a tubular fitting having said threads on an exterior thereof and having a flange at one end thereof, said projection extending through said opening in said base and having said flange disposed adjacent said base; and wherein said sealing structure includes an annular third gasket that extends around said projection between said flange and said flange.

5. An apparatus according to claim 4, wherein said projection has outwardly-facing holding surfaces in the region of an end remote from said base.

6. An apparatus according to claim 1, wherein said tag receiving portion includes a resilient portion configured to yieldably urge a tag toward said first end of said passageway.

7. An apparatus according to claim 6, wherein said resilient portion includes a leaf spring.

8. An apparatus according to claim 6, including a tag removably disposed in said tag receiving portion, said tag having an annular gasket thereon and said resilient portion causing said gasket on said tag to be sealingly pressed against an annular surface portion on said base that extends around said first end of said passageway, and said tag having a sensor for sensing a selected condition through a center opening in said gasket thereon in the region of said first end of said passageway.

9. An apparatus according to claim 1, wherein said second end of said passageway is remote from said tag receiving portion.

10. An apparatus according to claim 1, wherein said tag receiving portion is on a side of base opposite from said projection.

11. An apparatus comprising a tag that includes:

a housing having a wall portion with an opening therethrough and having thereon an annular surface portion that extends around said opening;

an annular gasket engaging said annular surface portion;

circuitry disposed within said housing, said circuitry including a sensor located in the region of said opening, and including a transmitter that can transmit wireless signals; and a sheet of filter material supported with respect to said housing so that all fluid flowing through said opening must flow through said sheet of filter material.

12. An apparatus according to claim 11, wherein said wall portion has said annular surface portion on an outer side thereof.

13. An apparatus according to claim 12, wherein said annular gasket is adhesively secured to said annular surface portion.

14. An apparatus according to claim 11, wherein said sensor detects at least one of temperature and humidity.

15. An apparatus according to claim 11, including a support having: a base with an opening therethrough; and a tag receiving portion provided on said base and configured to removably support said tag on said base so that said opening through said base is in the region of and communicates with said opening through said housing.

16. An apparatus comprising a tag that includes:

a housing having a wall portion with an opening therethrough and having thereon an annular surface portion that extends around said opening;

an annular gasket engaging said annular surface portion; and circuitry disposed within said housing, said circuitry including a sensor located in the region of said opening, and including a transmitter that can transmit wireless signals;

wherein said wall portion has said annular surface portion on an inner side thereof; and wherein said tag includes a circuit board having said sensor thereon, and having thereon an annular surface portion that extends around said sensor, said gasket sealing engaging said annular surface portion on said wall portion and said annular surface portion on said circuit board.

17. An apparatus according to claim 16, wherein said gasket includes a layer of a foam material with adhesive on each side thereof, said adhesive securing said gasket to each of said annular surface portions.

18. An apparatus according to claim 16, wherein said wall portion has on an outer side thereof a further annular surface portion that extends around said opening therethrough; and wherein said tag includes a further annular gasket engaging said further annular surface portion.

19. An apparatus according to claim 18, wherein said further annular gasket is adhesively secured to said further annular surface portion.

20. An apparatus according to claim 18, wherein said wall portion has a sensing recess in the outer side thereof, said opening through said wall portion communicating with said sensing recess, and said further annular surface portion extending around said sensing recess.

21. An apparatus according to claim 20, wherein said wall portion has a shallow gasket recess in the outer side thereof, said sensing recess being provided in a central portion of an inner surface of said gasket recess, and said further annular surface portion being provided within said gasket recess.

22. An apparatus according to claim 18, wherein said wall portion has a shallow gasket recess in the outer side thereof, said further annular surface portion being provided within said gasket recess.

23. An apparatus comprising a tag that includes:

a housing having a wall portion with an opening therethrough and having thereon an annular surface portion that extends around said opening;

an annular gasket engaging said annular surface portion; and circuitry disposed within said housing, said circuitry including a sensor located in the region of said opening, and including a transmitter that can transmit wireless signals;

wherein said wall portion has said annular surface portion on an outer side thereof; and wherein said wall portion has a sensing recess in the outer side thereof, said opening through said wall portion communicating with said sensing recess, and said annular surface portion extending around said sensing recess.

24. An apparatus according to claim 23, wherein said wall portion has a shallow gasket recess in the outer side thereof, said sensing recess being provided in a central portion of an inner surface of said gasket recess, and said annular surface portion being provided within said gasket recess.

* * * * *